US011781568B2

(12) United States Patent
Yang

(10) Patent No.: US 11,781,568 B2
(45) Date of Patent: Oct. 10, 2023

(54) PUMP OPERATED BY HAND OR PRESSURIZED AIR

(71) Applicant: Yin Jui Yang, Changhua (TW)

(72) Inventor: Yin Jui Yang, Changhua (TW)

( * ) Notice: Subject to any disclaimer, the term of this patent is extended or adjusted under 35 U.S.C. 154(b) by 0 days.

(21) Appl. No.: 17/817,357

(22) Filed: Aug. 4, 2022

(65) Prior Publication Data

US 2022/0372995 A1 Nov. 24, 2022

(51) Int. Cl.

| | |
|---|---|
| ***F04F 1/06*** | (2006.01) |
| ***F04B 9/14*** | (2006.01) |
| ***F04F 5/24*** | (2006.01) |

(52) U.S. Cl.

CPC ..... *F04F 1/06* (2013.01); *F04B 9/14* (2013.01); *F04F 5/24* (2013.01)

(58) Field of Classification Search

CPC ..... F04F 1/06; F04F 1/00; F04F 1/14; F04B 9/14; F04B 17/00; B67D 1/0437; B67D 2001/0493; B67D 1/0425; B05B 11/1097

USPC ..... 417/118

See application file for complete search history.

(56) References Cited

U.S. PATENT DOCUMENTS

| | | | | |
|---|---|---|---|---|
| 1,906,354 A * | 5/1933 | Andreasen | F04B 9/14 | 222/400.8 |
| 6,537,036 B1 * | 3/2003 | Broerman | F04F 5/48 | 417/198 |
| 7,093,624 B2 * | 8/2006 | Chen | F04B 33/00 | 141/59 |
| 9,222,471 B2 * | 12/2015 | Liao | F04B 39/14 | |
| 2007/0023365 A1 * | 2/2007 | Liao | F04B 33/00 | 210/776 |

* cited by examiner

*Primary Examiner* — Bryan M Lettman

(57) ABSTRACT

A pump includes a cylinder having a suction pipe; and inlet section including a housing, a lower threaded section, an upper nut secured to an upper threaded section, and an inlet having a first connector connected to a valve, a second connector having a connection element connected to the valve, a hollow projection opposite to the connection element and provided through the housing, and an axial hole through the hollow projection; a joining section secured to the cylinder and including a hollow first threaded section and a hollow first internally threaded section secured to a second externally threaded section; a manual operation section including a piston rod extending downward from a spring biased handle into the cylinder; an outlet section; and a safety valve. The safety valve releases pressurized air when the pressurized air reaches a pressure of 0.5 kgf/cm$^2$ at the safety valve.

6 Claims, 8 Drawing Sheets

PUMP OPERATED BY HAND OR PRESSURIZED AIR

FIELD OF THE INVENTION

The invention relates to pumps and more particularly to a pump operated either by hand or by pressurized air.

BACKGROUND OF THE INVENTION

A conventional hand pump 10 is shown in FIG. 8 and the pump 10 is inserted into a fuel tank 9. A user may lift a piston 102 to draw fuel out of the fuel tank 9. As a result, the fuel flows to a fuel container (not shown) through an outlet 101.

However, the fuel may leak out of the outlet 101 to pollute the environment after use.

Thus, the need for improvement still exists.

SUMMARY OF THE INVENTION

It is therefore one object of the invention to provide a pump comprising a suction pipe; a cylinder having a lower end formed with the suction pipe; an inlet section including a housing having an internal space, a lower externally threaded section, an upper externally threaded section, an upper nut threadedly secured to the upper externally threaded section, a plurality of first O-rings provided on the cylinder, and an inlet having a valve, a first connector having one end connected to the valve, and a second connector having a connection element connected to the valve, a hollow projection opposite to the connection element and provided through the housing, and an axial hole through the hollow projection; a joining section secured to an upper end of the cylinder and including a hollow first externally threaded section, a hollow second externally threaded section, and a hollow first internally threaded section secured to the second externally threaded section; a manual operation section including a handle, a piston rod extending downward from the handle and passing through the first internally threaded section and the second externally threaded section into the cylinder, a suction member provided at an end of the piston rod, and a biasing member biased between the handle and the first internally threaded section; an outlet section including a bent outlet, a valve member having one end connected to the outlet, an externally threaded channel having one end connected to the other end of the valve member and the other end connected to and communicating with inside of the joining section, a hollow second internally threaded section secured to both the externally threaded channel and the first externally threaded section, and a plurality of second O-rings disposed between the externally threaded channel and the first externally threaded section; and a safety valve disposed through the housing and configured to open in response to irregularity.

The above and other objects, features and advantages of the invention will become apparent from the following detailed description taken with the accompanying drawings

DETAILED DESCRIPTION OF THE INVENTION

Figure 1:
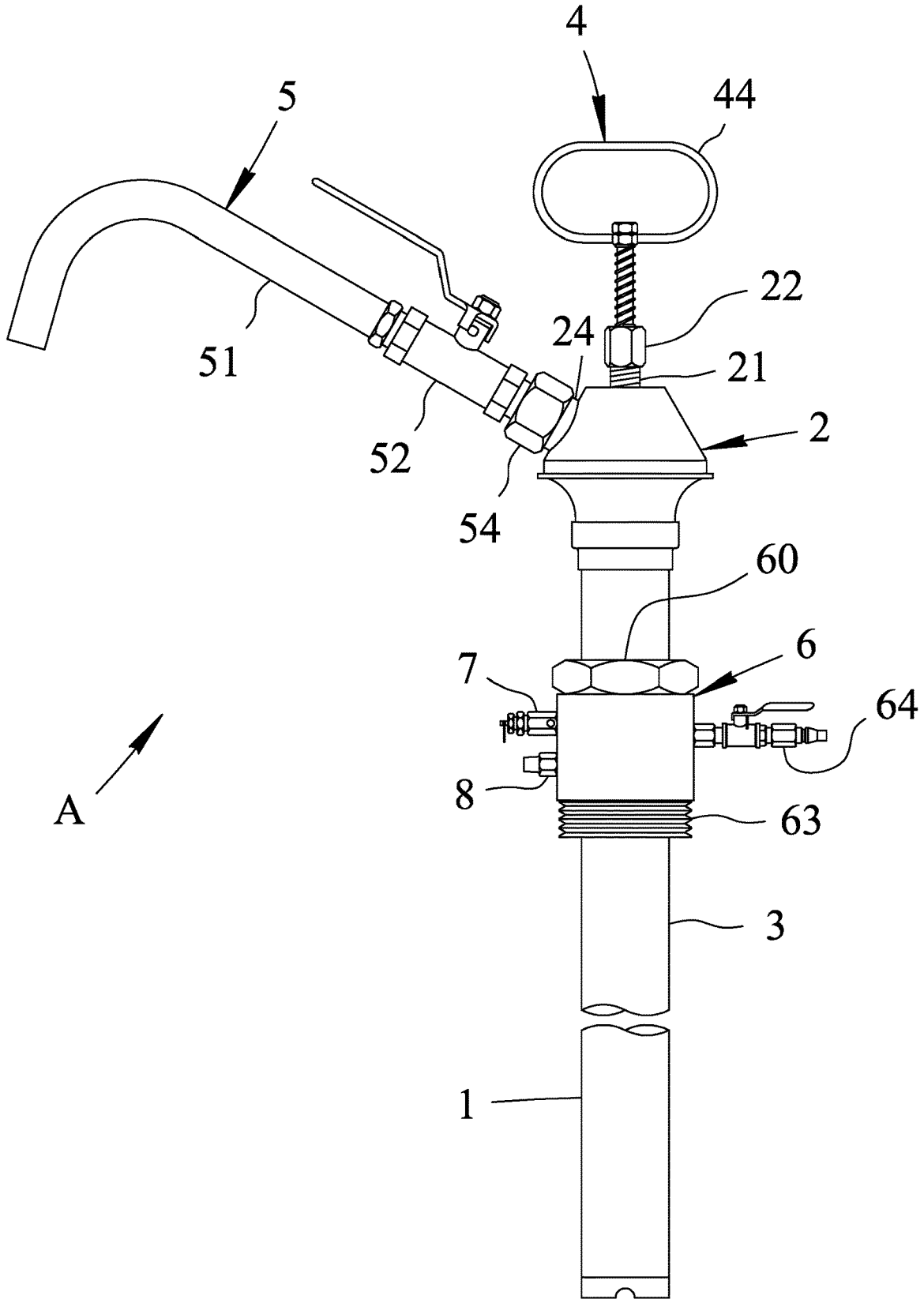
FIG. 1 is a side elevation of a pump of the invention.
Figure 2:
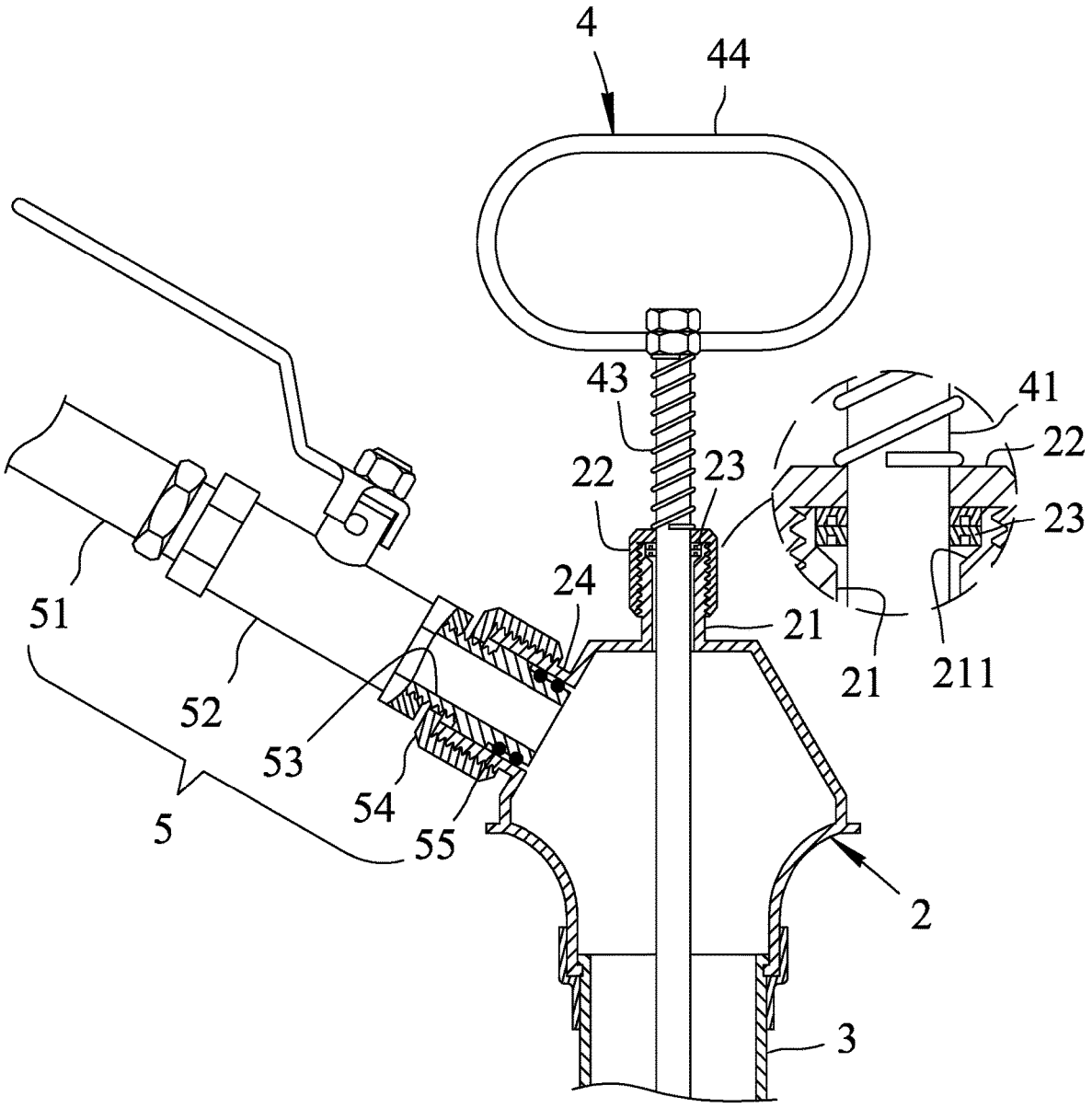
FIG. 2 is an enlarged view of an upper part of the pump with portions shown in section.
Figure 3:
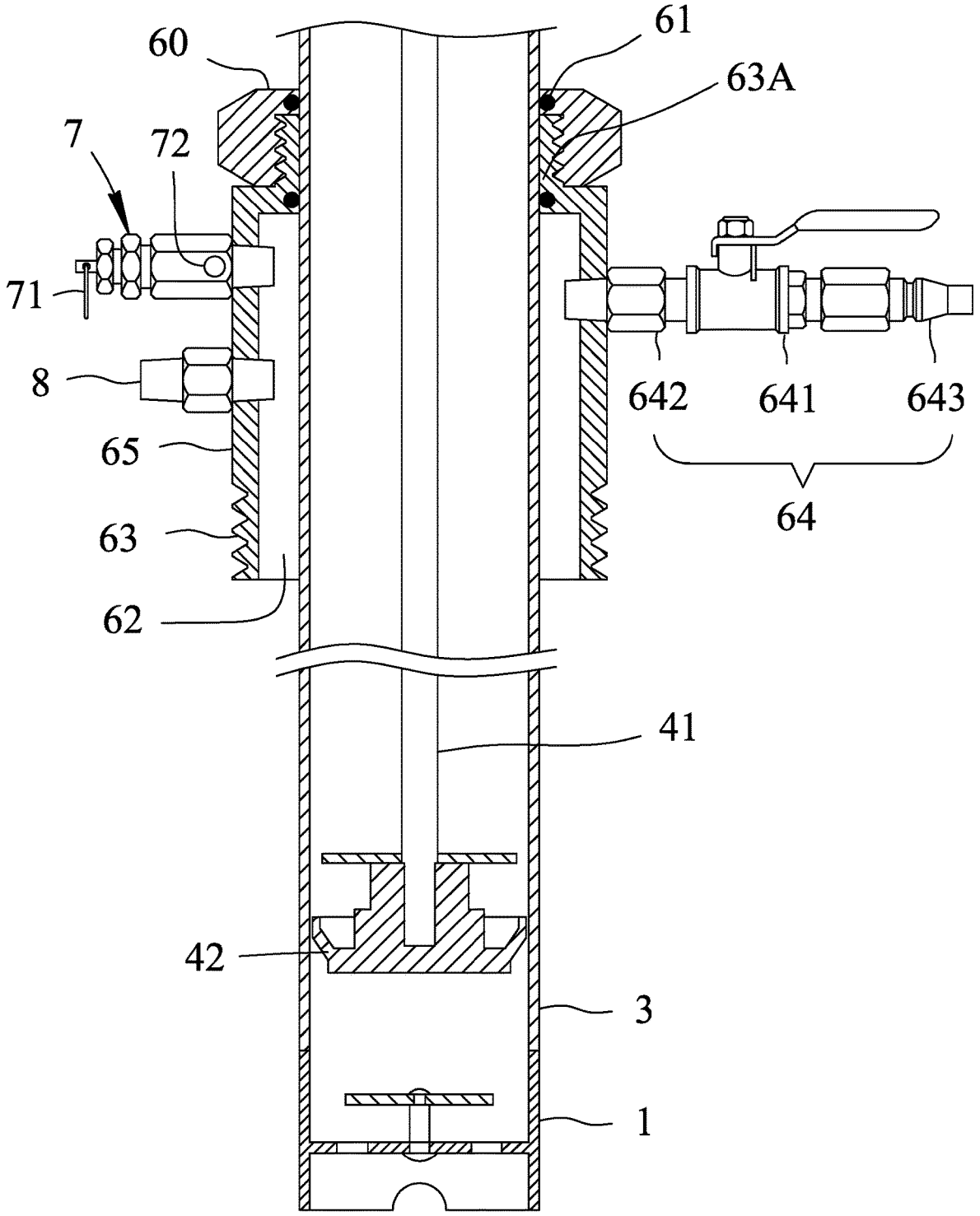
FIG. 3 is an enlarged view of a lower part of the pump with portions shown in section.
Figure 4:
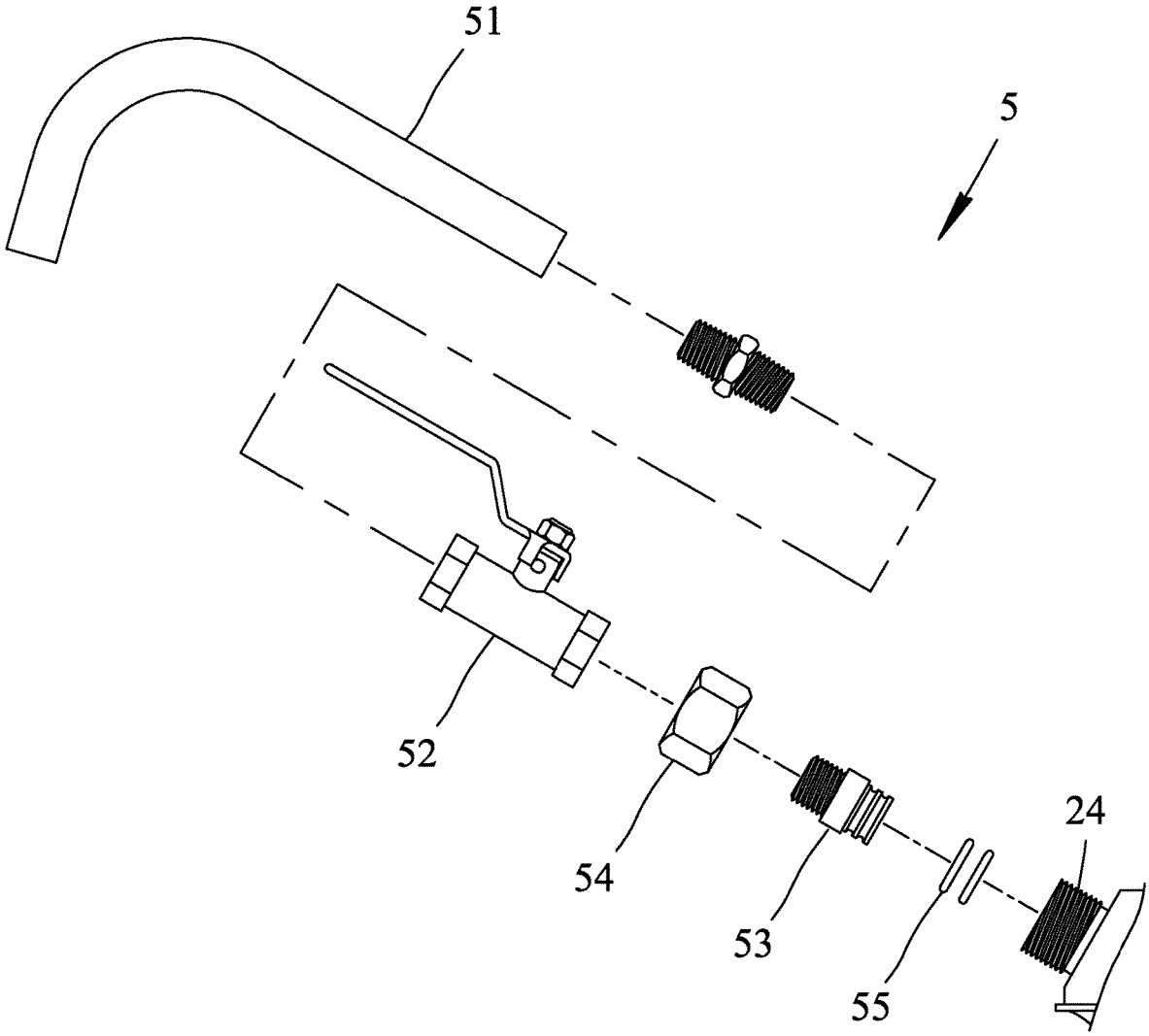
FIG. 4 is an exploded view of the outlet and adjacent components.
Figure 5:
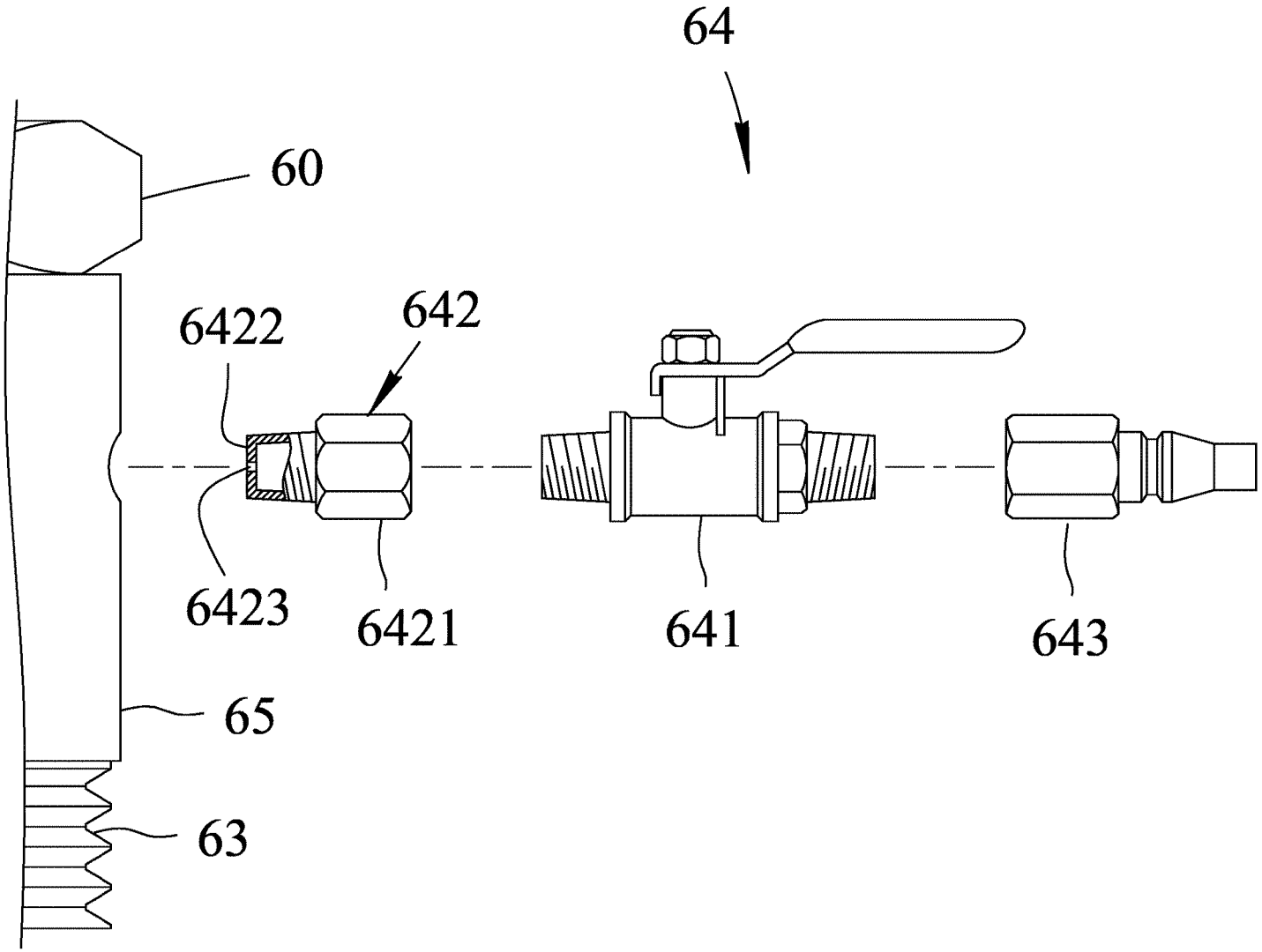
FIG. 5 is an exploded view of the inlet section.
Figure 6:
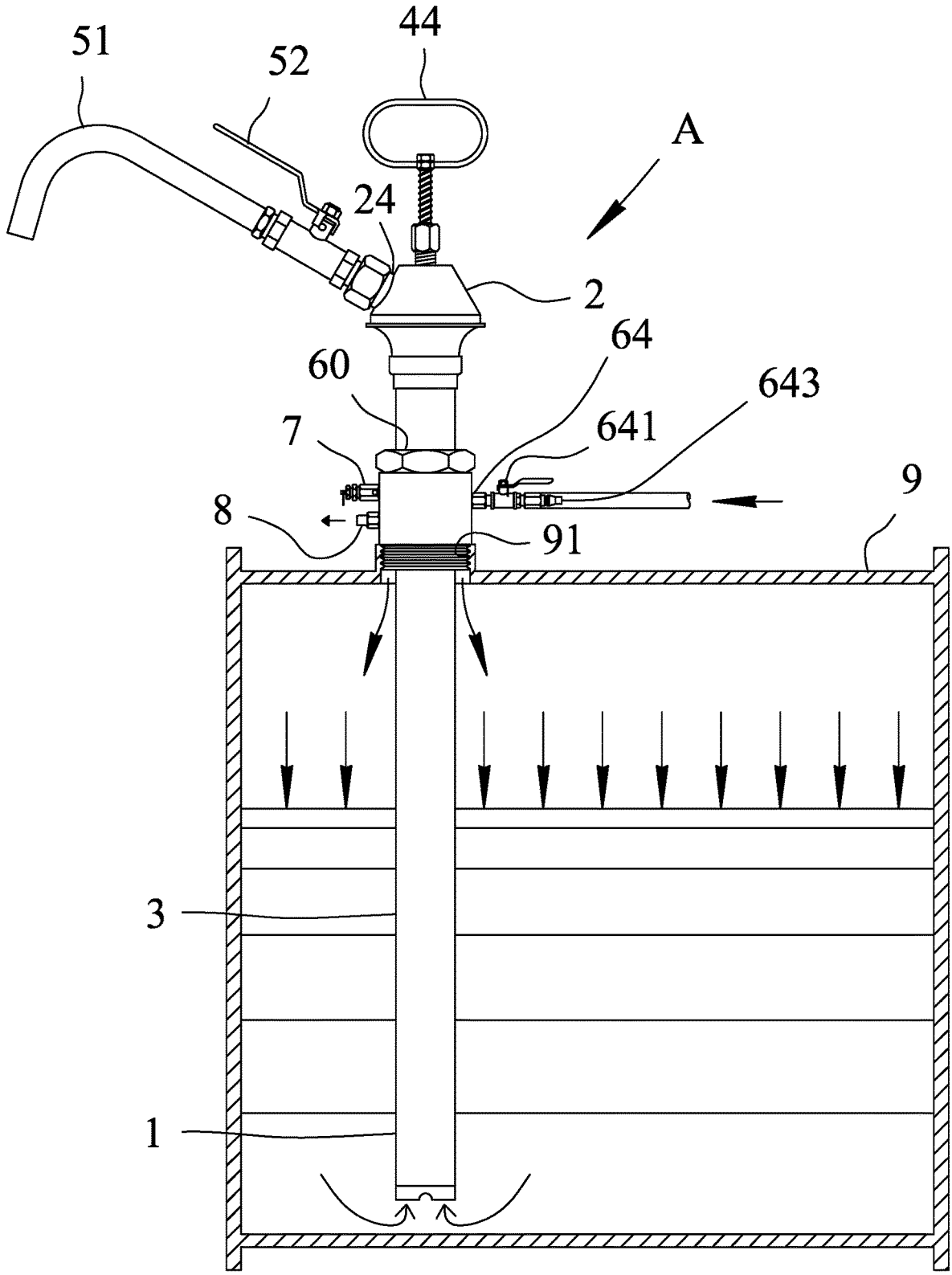
FIG. 6 schematically depicts an operation of the pump.
Figure 7:
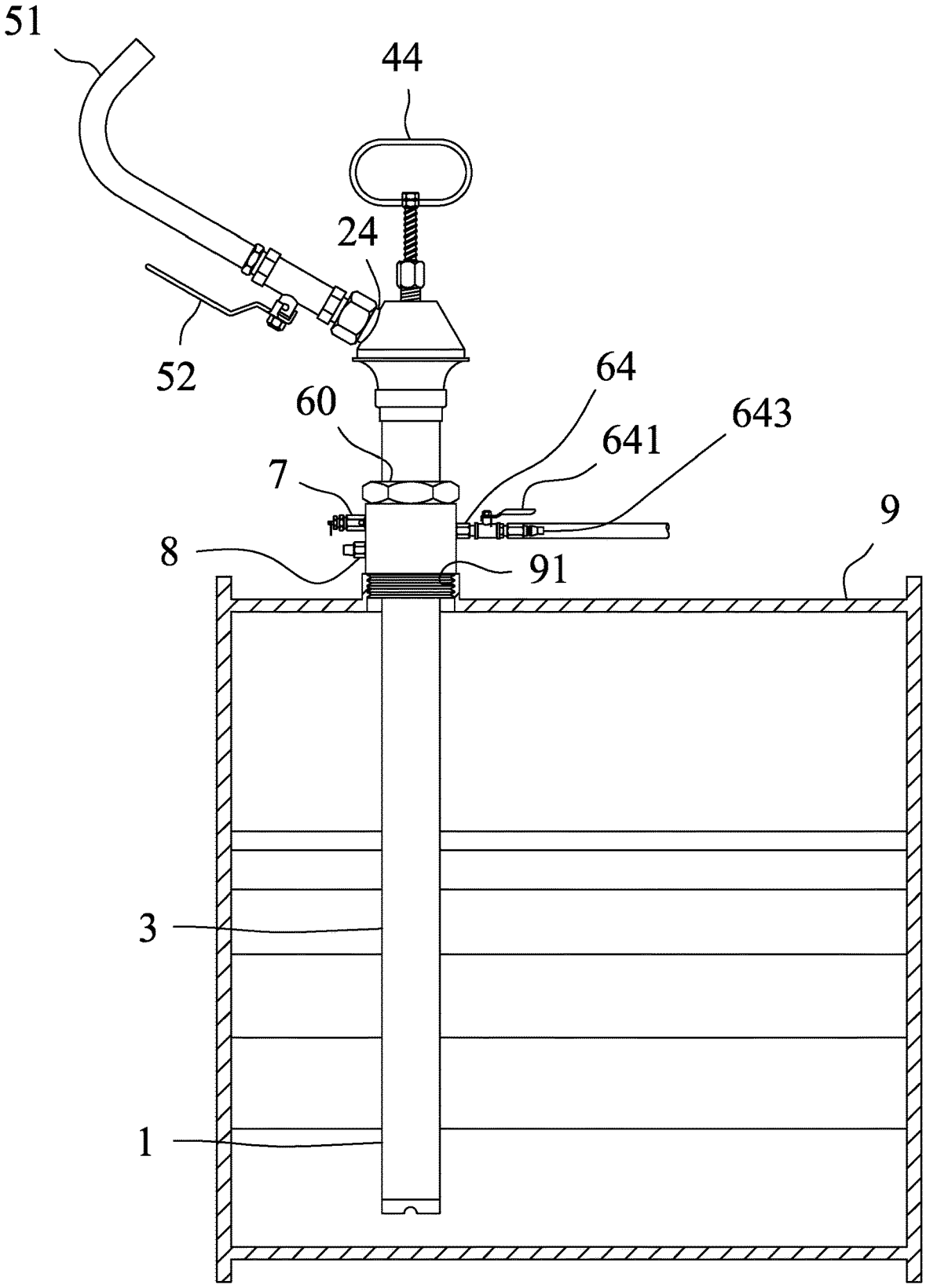
FIG. 7 schematically depicts the outlet being oriented upward by rotating after the operation of the pump.
Figure 8:
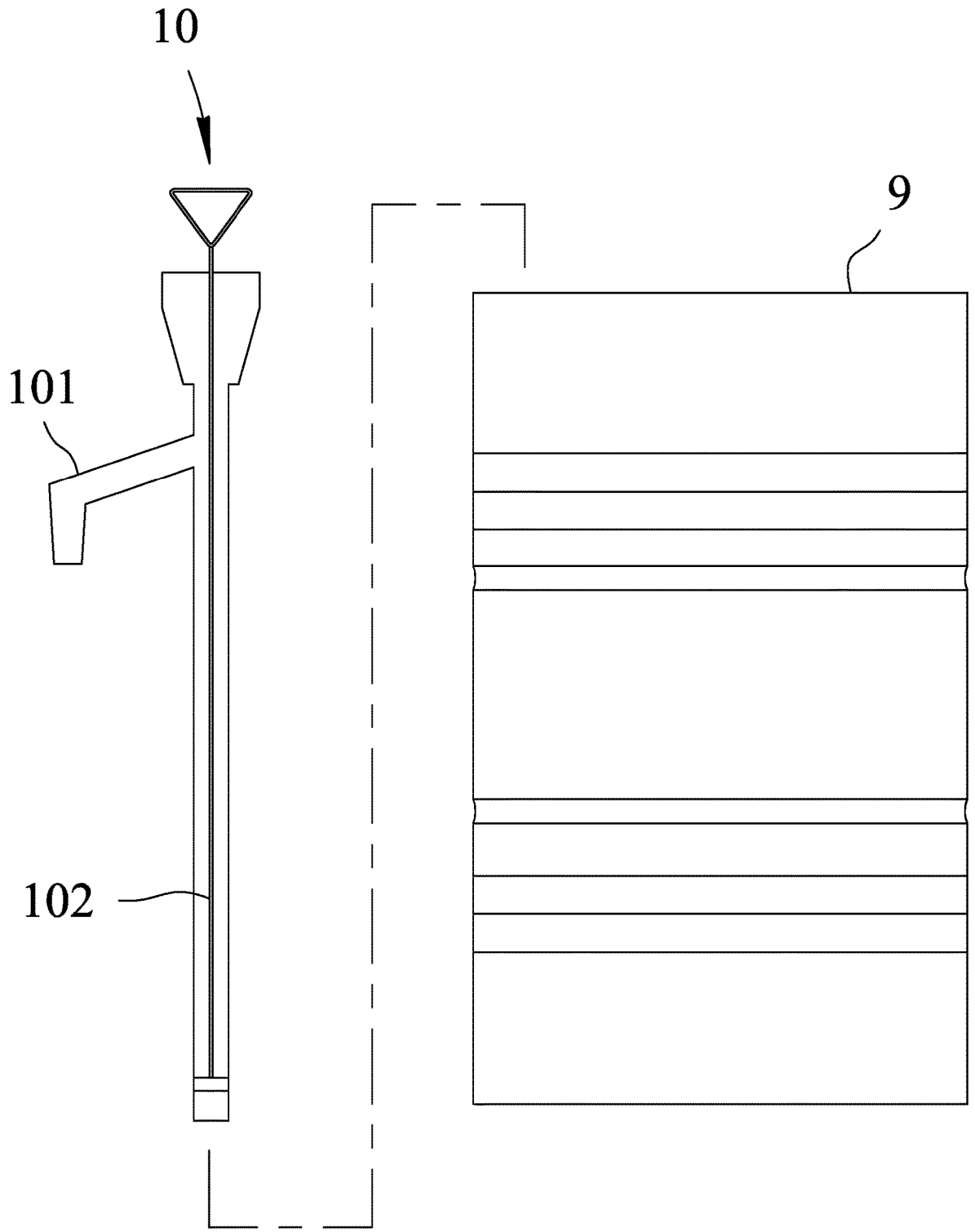
FIG.8 Prior Art
FIG. 8 schematically depicts a conventional hand pump and a fuel tank.

Referring to FIGS. 1 to 7, a pump A of the invention comprises the follow components as described in detail below.

A suction pipe 1 is configured to insert into a fuel tank 9. A cylinder 3 having a lower end formed with the suction pipe 1. An inlet section 6 includes a housing 65, an internal space 62, a lower externally threaded section 63, an upper hexagonal nut 60 threadedly secured to an upper externally threaded section 63A, two upper O-rings 61 provided on the cylinder 3 for preventing leakage, and an inlet 64 including a valve 641, a first connector 643 having one end connected to the valve 641 and the other end connected to a pneumatic power source (e.g., air compressor) (not shown), a second connector 642 having a connection element 6421 connected to the valve 641, a hollow projection 6422 opposite to the connection element 6421 and provided through the housing 65, and an axial hole 6423 having a diameter of 1 mm disposed through the hollow projection 6422. The air compressor can generate pressurized air having a pressure of 7-9 $kgf/cm^2$ at a rate of 747 liter/minute. The pressurized air flows at a rate of 85-95 liter/minute through the second connector 642. Pressure of the pressurized air is decreased greatly (e.g., 0.19 times of the initial rate) after passing through the second connector 642. In the embodiment, the pressurized air passes through the hole 6423 at a rate of 89 liter/minute.

A joining section 2 is secured to an upper end of the cylinder 3 and includes a hollow first externally threaded section 24, a hollow, upper second externally threaded section 21, a hollow, internally threaded section 22 configured to secure to the second externally threaded section 21, and two O-rings 23 disposed between an upper inclined end 211 of the second externally threaded section 21 and a bottom of the top of the internally threaded section 22. A manual operation section 4 includes a handle 44, a piston rod 41 extending downward from the handle 44 and passing through the internally threaded section 22, the O-rings 23, and the second externally threaded section 21 into the cylinder 3, a suction member 42 is formed at an end of the piston rod 41, and a torsion spring 43 biased between the handle 44 and the internally threaded section 22.

An outlet section 5 includes a bent outlet 51, a valve 52 having one end connected to the outlet 51, an externally threaded channel 53 having one end connected to the other end of the valve 52 and the other end communicating with inside of the joining section 2, a hollow internally threaded section 54 secured to both the externally threaded channel 53 and the first externally threaded section 24, and two O-rings 55 disposed between the externally threaded channel 53 and the first externally threaded section 24.

A valve 7 is provided through the housing 65 and includes a port 72 and a pull ring 71. A user may pull the pull ring 71 to open the port 72 so that excessive pressure in the fuel tank 9 may flow to the atmosphere via the internal space 62 and the open port 72.

A safety valve 8 is provided under the valve 7 and also provided through the housing 65. The safety valve 8 automatically releases pressurized air from the fuel tank 9 via the internal space 62 when the pressure inside the fuel tank 9 exceeds a preset limit (e.g., 0.5 kgf/cm$^2$).

Prior to an operation of the pump A, the lower externally threaded section 63 is secured to an internally threaded opening 91 of the fuel tank 9 after the suction pipe 1 has been inserted into the fuel tank 9. Further, a user can use one of two operating modes as described below.

In a manual mode of the operation, a user may repeatedly push the handle 44 with the spring 43 compressed and the piston rod 41 moved downward, and pull the handle 44 the spring 43 expanded and the piston rod 41 moved upward. As a result, fuel in the fuel tank 9 is sucked to flow to the outlet 51 for exit via the suction pipe 1, the cylinder 3, the joining section 2, and the outlet section 5.

In a pneumatic mode of the operation, the user may sequentially open the valve 52, connect the first connector 643 to the air compressor, and open the valve 641. Pressure of pressurized air from the air compressor is decreased after passing through the second connector 642. Further, the pressurized air passes though the internal space 62 and the opening 91 prior to entering the fuel tank 9. Fuel in the fuel tank 9 is pressurized by the pressurized air to flow upward along the suction pipe 1, the cylinder 3, an annular gap between the suction member 42 and an inner surface of the cylinder 3, the joining section 2, and the first externally threaded section 24 prior to leaving the outlet 51. After the pumping operation, the user may close the valve 641. Thus, the pressure inside the fuel tank 9 is less than the preset limit (e.g., 0.5 kgf/cm$^2$) due to the closure of the closure of the valve 641 and pressure released by the safety valve 8. Thus, remaining fuel in the outlet section 5, the joining section 2, and the cylinder 3 flows back to the suction pipe 1. Next, the user may close the valve 52. Finally, the user may rotate the outlet 51 180 degrees to face upward. This can prevent remaining fuel in the outlet 51 from dropping on the ground. Otherwise, the ground may be polluted.

While the invention has been described in terms of preferred embodiments, those skilled in the art will recognize that the invention can be practiced with modifications within the spirit and scope of the appended claims.

What is claimed is:

1. A pump comprising:

a suction pipe;

a cylinder having a lower end formed with the suction pipe;

an inlet section including a housing having an internal space, a lower externally threaded section, an upper externally threaded section, an upper nut threadedly secured to the upper externally threaded section, a plurality of first O-rings provided on the cylinder, and an inlet having a valve, a first connector having one end connected to the valve, and a second connector having a connection element connected to the valve, a hollow projection opposite to the connection element and provided through the housing, and an axial hole through the hollow projection;

a joining section secured to an upper end of the cylinder and including a hollow first externally threaded section, a hollow second externally threaded section, and a hollow first internally threaded section secured to the second externally threaded section;

a manual operation section including a handle, a piston rod extending downward from the handle and passing through the first internally threaded section and the second externally threaded section into the cylinder, a suction member provided at an end of the piston rod, and a biasing member biased between the handle and the first internally threaded section;

an outlet section including a bent outlet, a valve member having one end connected to the outlet, an externally threaded channel having one end connected to the other end of the valve member and the other end connected to and communicating with an inside of the joining section, a hollow second internally threaded section secured to both the externally threaded channel and the first externally threaded section, and a plurality of second O-rings disposed between the externally threaded channel and the first externally threaded section; and a safety valve disposed through the housing and configured to open in response to an irregular pressure.

2. The pump of claim 1, wherein the second externally threaded section includes an upper inclined end, further comprising a plurality of third O-rings disposed between the upper inclined end and a bottom of the top of the first internally threaded section.

3. The pump of claim 1, wherein the axial hole has a diameter of 1 mm and the pressurized air is configured to flow at a rate of 85-95 liter/minute through the second connector.

4. The pump of claim 3, wherein the pressurized air is configured to flow at a rate of 89 liter/minute through the axial hole.

5. The pump of claim 1, further comprising a valve element disposed in the housing, the valve element including a port and a pull ring.

6. The pump of claim 1, wherein the safety valve is configured to release pressurized air when the pressurized air reaches a pressure of 0.5 kgf/cm$^2$ at the safety valve.

* * * * *